US009263168B2

(12) United States Patent
Sekiya et al.

(10) Patent No.: US 9,263,168 B2
(45) Date of Patent: Feb. 16, 2016

(54) ALUMINUM ALLOY WIRE ROD, ALUMINUM ALLOY STRANDED WIRE, COATED WIRE, WIRE HARNESS AND MANUFACTURING METHOD OF ALUMINUM ALLOY WIRE ROD

(71) Applicants: FURUKAWA ELECTRIC CO., LTD., Tokyo (JP); FURUKAWA AUTOMOTIVE SYSTEMS INC., Inukami-gun, Shiga (JP)

(72) Inventors: Shigeki Sekiya, Tokyo (JP); Sho Yoshida, Tokyo (JP); Kyota Susai, Tokyo (JP); Kengo Mitose, Tokyo (JP)

(73) Assignees: FURUKAWA ELECTRIC CO., LTD., Tokyo (JP); FURUKAWA AUTOMOTIVE SYSTEMS INC., Inukami-Gun, Shiga ( * ) Notice: Subject to any disclaimer, the term of this patent is extended or adjusted under 35 U.S.C. 154(b) by 0 days.

(21) Appl. No.: 14/681,767

(22) Filed: Apr. 8, 2015

(65) Prior Publication Data

US 2015/0213914 A1 Jul. 30, 2015

Related U.S. Application Data

(63) Continuation of application No. PCT/JP2013/080956, filed on Nov. 15, 2013.

(30) Foreign Application Priority Data

Mar. 29, 2013 (JP) ..... 2013-075404

(51) Int. Cl.
*H01B 1/02* (2006.01)
*C22C 21/00* (2006.01)

(Continued)

(52) U.S. Cl.
CPC ..... *H01B 1/023* (2013.01); *C22C 21/00* (2013.01); *C22C 21/02* (2013.01); *C22C 21/04* (2013.01);

(Continued)

(58) Field of Classification Search
CPC combination set(s) only.
See application file for complete search history.

(56) References Cited

U.S. PATENT DOCUMENTS

2006/0013719 A1* 1/2006 Ichikawa ..... C22C 21/10 419/29
2007/0221396 A1* 9/2007 Izumida ..... C21D 8/06 174/128.1
2010/0059151 A1* 3/2010 Iwamura ..... C22C 21/12 148/690

FOREIGN PATENT DOCUMENTS

JP 59-47365 A 3/1984
JP 2003-105473 A 4/2003

(Continued)

OTHER PUBLICATIONS

Decision to Grant a Patent, received on Aug. 11, 2014 in a corresponding JP application No. 2014-508616.

(Continued)

*Primary Examiner* — Timothy Thompson
*Assistant Examiner* — Krystal Robinson
(74) *Attorney, Agent, or Firm* — Birch, Stewart, Kolasch & Birch, LLP

(57) ABSTRACT

An aluminum alloy wire rod has a composition consisting of 0.10-1.00 mass % Mg; 0.10-1.00 mass % Si; 0.01-1.40 mass % Fe; 0.000-0.100 mass % Ti; 0.000-0.030 mass % B; 0.00-1.00 mass % Cu; 0.00-0.50 mass % Ag; 0.00-0.50 mass % Au; 0.00-1.00 mass % Mn; 0.00-1.00 mass % Cr; 0.00-0.50 mass % Zr; 0.00-0.50 mass % Hf; 0.00-0.50 mass % V; 0.00-0.50 mass % Sc; 0.00-0.50 mass % Co; 0.00-0.50 mass % Ni; and the balance being Al and incidental impurities, wherein at least one of Ti, B, Cu, Ag, Au, Mn, Cr, Zr, Hf, V, Sc, Co and Ni is contained in the composition or none of Ti, B, Cu, Ag, Au, Mn, Cr, Zr, Hf, V, Sc, Co and Ni is contained in the composition. A precipitate free zone exists inside a crystal grain, and the precipitate free zone has a width of less than or equal to 100 nm.

12 Claims, 1 Drawing Sheet

(51) Int. Cl.

| | |
|---|---|
| ***C22F 1/00*** | (2006.01) |
| ***C22F 1/04*** | (2006.01) |
| ***C22C 21/02*** | (2006.01) |
| ***C22C 21/08*** | (2006.01) |
| ***C22C 21/04*** | (2006.01) |
| ***C22C 21/14*** | (2006.01) |
| ***C22C 21/16*** | (2006.01) |
| ***C22F 1/043*** | (2006.01) |
| ***C22F 1/047*** | (2006.01) |
| ***C22F 1/05*** | (2006.01) |
| ***C22F 1/057*** | (2006.01) |
| ***H01B 3/30*** | (2006.01) |
| ***H01B 7/00*** | (2006.01) |

(52) U.S. Cl.

CPC ..... *C22C 21/08* (2013.01); *C22C 21/14* (2013.01); *C22C 21/16* (2013.01); *C22F 1/00* (2013.01); *C22F 1/04* (2013.01); *C22F 1/043* (2013.01); *C22F 1/047* (2013.01); *C22F 1/05* (2013.01); *C22F 1/057* (2013.01); *H01B 3/30* (2013.01); *H01B 7/0045* (2013.01)

(56) References Cited

FOREIGN PATENT DOCUMENTS

| | | | |
|---|---|---|---|
| JP | 2012-229485 | A | 11/2012 |
| JP | 2013-44040 | A | 3/2013 |

OTHER PUBLICATIONS

International Search Report, issued in PCT/JP2013/080956, dated Feb. 4, 2014.

Notification of Reasons for Refusal, received on May 19, 2014 in a corresponding JP application No. 2014-508616.

Written Opinion of the International Searching Authority, issued in PCT/JP2013/080956, dated Feb. 4, 2014.

English translation of International Preliminary Report on Patentability dated Sep. 29, 2015, issued in PCT/JP2013/080956 (Form PCT/IB/373).

Written Opinion of the International Searching Authority dated Feb. 4, 2014, and issued Sep. 29, 2015 in PCT/JP2013/080956 (Form PCT/ISA/237).

* cited by examiner

ALUMINUM ALLOY WIRE ROD, ALUMINUM ALLOY STRANDED WIRE, COATED WIRE, WIRE HARNESS AND MANUFACTURING METHOD OF ALUMINUM ALLOY WIRE ROD

CROSS REFERENCE TO RELATED APPLICATIONS

This is a continuation application of International Patent Application No. PCT/JP2013/080956 filed Nov. 15, 2013, which claims the benefit of Japanese Patent Application No. 2013-075404, filed Mar. 29, 2013, the full contents of all of which are hereby incorporated by reference in their entirety.

BACKGROUND

1. Technical Field

The present disclosure relates to an aluminum alloy wire rod used as a conductor of an electric wiring structure, an aluminum alloy stranded wire, a coated wire, a wire harness, and a method of manufacturing an aluminum alloy wire, and particularly relates to an aluminum alloy wire rod that has an improved impact resistance and bending fatigue resistance while ensuring strength, elongation and conductivity equivalent to the related art products, even when used as an extra fine wire having a wire diameter of less than or equal to 0.5 mm.

2. Background

In the related art, a so-called wire harness has been used as an electric wiring structure for transportation vehicles such as automobiles, trains, and aircrafts, or an electric wiring structure for industrial robots. The wire harness is a member including electric wires each having a conductor made of copper or copper alloy and fitted with terminals (connectors) made of copper or copper alloy (e.g., brass). With recent rapid advancements in performances and functions of automobiles, various electrical devices and control devices installed in vehicles tend to increase in number and electric wiring structures used for devices also tends to increase in number. On the other hand, for environmental friendliness, lightweighting of transportation vehicles is strongly desired for improving fuel efficiency of transportation vehicles such as automobiles.

As one of the measures for achieving lightweighting of transportation vehicles, there have been, for example, continuous efforts in the studies of using aluminum or aluminum alloys as a conductor of an electric wiring structure, which is more lightweight, instead of conventionally used copper or copper alloys. Since aluminum has a specific gravity of about one-third of a specific gravity of copper and has a conductivity of about two-thirds of a conductivity of copper (in a case where pure copper is a standard for 100% IACS, pure aluminum has approximately 66% IACS), an aluminum conductor wire rod needs to have a cross sectional area of approximately 1.5 times greater than that of a copper conductor wire rod to allow the same electric current as the electric current flowing through the copper conductor wire rod to flow through the pure aluminum conductor wire rod. Even an aluminum conductor wire rod having an increased cross section as described above is used, using an aluminum conductor wire rod is advantageous from the viewpoint of lightweighting, since an aluminum conductor wire rod has a mass of about half the mass of a pure copper conductor wire rod. Note that, "% IACS" represents a conductivity when a resistivity $1.7241\times10^{-8}$ Ωm of International Annealed Copper Standard is taken as 100% IACS.

However, it is known that pure aluminum wire rods, typically an aluminum alloy wire rod for transmission lines (JIS (Japanese Industrial Standard) A1060 and A1070), is generally poor in its durability to tension, resistance to impact, and bending characteristics. Therefore, for example, it cannot withstand a load abruptly applied by an operator or an industrial device while being installed to a car body, a tension at a crimp portion of a connecting portion between an electric wire and a terminal, and a cyclic stress loaded at a bending portion such as a door portion. On the other hand, an alloyed material containing various additive elements added thereto is capable of achieving an increased tensile strength, but a conductivity may decrease due to a solution phenomenon of the additive elements into aluminum, and because of excessive intermetallic compounds formed in aluminum, a wire break due to the intermetallic compounds may occur during wire drawing. Therefore, it is essential to limit or select additive elements to provide sufficient elongation characteristics to prevent a wire break, and it is further necessary to improve impact resistance and bending characteristics while ensuring a conductivity and a tensile strength equivalent to those of the related art.

For example, aluminum alloy wire rods containing Mg and Si are known as high strength aluminum alloy wire rods. A typical example of this aluminum alloy wire rod is a 6xxx series aluminum alloy (Al—Mg—Si based alloy) wire rod. Generally, the strength of the 6xxx series aluminum alloy wire rod can be increased by applying a solution treatment and an aging treatment. However, when manufacturing an extra fine wire such as a wire having a wire size of less than or equal to 0.5 mm using a 6xxx series aluminum alloy wire rod, although the strength can be increased by applying a solution heat treatment and an ageing treatment, the elongation tends to be insufficient.

For example, Japanese Laid-Open Patent Publication No. 2012-229485 discloses a conventional 6xxx series aluminum alloy wire used for an electric wiring structure of the transportation vehicle. An aluminum alloy wire disclosed in Japanese Laid-Open Patent Publication No. 2012-229485 is an extra fine wire that can provide an aluminum alloy wire having a high strength and a high conductivity, as well as an improved elongation. Also, Japanese Laid-Open Patent Publication No. 2012-229485 discloses that sufficient elongation results in improved bending characteristics. However, for example, it is neither disclosed nor suggested to use an aluminum alloy wire as a wire harness attached to a door portion, and there is no disclosure or suggestion about impact resistance or bending fatigue resistance under a severe operating environment in which a fatigue fracture is likely to occur due to repeated bending stresses exerted by opening and closing of the door.

The present disclosure is related to providing an aluminum alloy wire rod used as a wire rod of an electric wiring structure, an aluminum alloy stranded wire, a coated wire, a wire harness, and a method of manufacturing an aluminum alloy wire rod that has an improved impact resistance and bending fatigue resistance while ensuring strength, elongation and conductivity equivalent to those of a product of the related art (aluminum alloy wire disclosed in Japanese Laid-Open Patent Publication No. 2012-229485), even when it is a prerequisite to use an aluminum alloy containing Mg and Si and by making a microstructure appropriate, and particularly when used as an extra fine wire having a strand diameter of less than or equal to 0.5 mm.

The present inventors have observed a microstructure of the aluminum alloy wire of the related art containing Mg and Si, and found that a zone free of precipitates consisting of a compound of, for example, Mg, Si, Fe, Ti, B, Cu, Ag, Au, Mn, Cr, Zr, Hf, V, Sc, Co and Ni, which are alloy elements added into aluminum, is formed at a portion of a grain that is inside the grain and located in the vicinity of a grain boundary. Such region is a so-called precipitate free zone (PFZ: Precipitate Free Zone). Then, the present inventors have carried out assiduous studies under the assumption that such PFZ has a composition substantially equivalent to that of a pure aluminum and thus has a property equivalent to that of a pure aluminum, resulting in a decrease in a tensile strength, elongation, impact resistance and bending fatigue resistance.

The present inventors have prepared various types of aluminum alloy wires with various widths of precipitate free zone (PFZ) formed at a portion of a grain that is inside the grain and located in the vicinity of the grain boundary by controlling a component composition and a manufacturing process, and carried out a comparison. As a result, it was found that, in a case where the width of the precipitate free zone (PFZ) is made narrow to a certain extent, an improved impact resistance and bending fatigue resistance can be achieved while ensuring strength, elongation and conductivity equivalent to those of a product of the related art (aluminum alloy wire disclosed in Japanese Laid-Open Patent Publication No. 2012-229485).

Further, the present inventors have found that since a portion which is a precipitate free zone (PFZ) has a soft and easily deformable structure, and a portion where precipitates exist (precipitate zone) has a structure which is comparatively rigid and difficult to deform, a grain boundary strength and an elongation decrease. Accordingly, the present inventors have also found that reducing the width of the precipitate free zone (PFZ) is preferable in improving tensile strength and elongation (uniform elongation), and contrived the present disclosure.

Note that when an aluminum alloy wire rod is non-uniformly deformed, a local elongation occurs and a cross section area of the aluminum alloy wire becomes locally small, and as a result, a conductor resistance increases and there is a risk that an electric wire may give off smoke due to joule heat emitted by the aluminum alloy wire itself. This tendency becomes particularly noticeable when such an aluminum alloy wire is used as an extra fine wire having a strand diameter of less than or equal to 0.5 mm, since a contribution ratio of the PFZ width to the cross sectional area becomes higher.

Further, in Japanese Laid-Open Patent Publication No. 2003-105473, which was also filed by the present applicant and which is an unexamined application laid open to public, the applicant has already proposed an aluminum alloy sheet having an improved bending workability and draw-molding by reducing the width of PFZ. However, in the technique disclosed in Japanese Laid-Open Patent Publication No. 2003-105473, it is not considered to suppress the aforementioned non-uniform deformation which tends to occur when forming an aluminum alloy wire from an aluminum alloy wire rod by wire drawing and it is also not considered to improve impact resistance and bending fatigue resistance which are properties necessary for an aluminum alloy wire used under a severe operating environment in which a fatigue fracture is likely to occur due to repeated bending stress applied due to opening and closing of a door.

SUMMARY

According to a first aspect of the present disclosure, an aluminum alloy wire rod has a composition consisting of 0.10 mass % to 1.00 mass % Mg; 0.10 mass % to 1.00 mass % Si; 0.01 mass % to 1.40 mass % Fe; 0.000 mass % to 0.100 mass % Ti; 0.000 mass % to 0.030 mass % B; 0.00 mass % to 1.00 mass % Cu; 0.00 mass % to 0.50 mass % Ag; 0.00 mass % to 0.50 mass % Au; 0.00 mass % to 1.00 mass % Mn; 0.00 mass % to 1.00 mass % Cr; 0.00 mass % to 0.50 mass % Zr; 0.00 mass % to 0.50 mass % Hf; 0.00 mass % to 0.50 mass % V; 0.00 mass % to 0.50 mass % Sc; 0.00 mass % to 0.50 mass % Co; 0.00 mass % to 0.50 mass % Ni; and the balance being Al and incidental impurities, wherein at least one of Ti, B, Cu, Ag, Au, Mn, Cr, Zr, Hf, V, Sc, Co and Ni is contained in the composition or none of Ti, B, Cu, Ag, Au, Mn, Cr, Zr, Hf, V, Sc, Co and Ni is contained in the composition, a precipitate free zone exists inside a crystal grain, and the precipitate free zone has a width of less than or equal to 100 nm.

According to a second aspect of the present disclosure, wire harness includes a coated wire including a coating layer at an outer periphery of one of an aluminum alloy wire rod and an aluminum alloy stranded wire, the aluminum alloy stranded wire comprising a plurality of the aluminum alloy wire rods which are stranded together, and a terminal fitted at an end portion of the coated wire, the coating layer being removed from the end portion, wherein the aluminum alloy wire rod has a composition consisting of 0.10 mass % to 1.00 mass % Mg; 0.10 mass % to 1.00 mass % Si; 0.01 mass % to 1.40 mass % Fe; 0.000 mass % to 0.100 mass % Ti; 0.000 mass % to 0.030 mass % B; 0.00 mass % to 1.00 mass % Cu; 0.00 mass % to 0.50 mass % Ag; 0.00 mass % to 0.50 mass % Au; 0.00 mass % to 1.00 mass % Mn; 0.00 mass % to 1.00 mass % Cr; 0.00 mass % to 0.50 mass % Zr; 0.00 mass % to 0.50 mass % Hf; 0.00 mass % to 0.50 mass % V; 0.00 mass % to 0.50 mass % Sc; 0.00 mass % to 0.50 mass % Co; 0.00 mass % to 0.50 mass % Ni; and the balance being Al and incidental impurities, wherein at least one of Ti, B, Cu, Ag, Au, Mn, Cr, Zr, Hf, V, Sc, Co and Ni is contained in the composition or none of Ti, B, Cu, Ag, Au, Mn, Cr, Zr, Hf, V, Sc, Co and Ni is contained in the composition, a precipitate free zone exists inside a crystal grain, and the precipitate free zone has a width of less than or equal to 100 nm.

According to a third aspect of the present disclosure, a method of manufacturing an aluminum alloy wire rod according to the first aspect of the disclosure, the aluminum alloy wire rod being obtained by forming a drawing stock through hot or cold working subsequent to melting and casting, and thereafter carrying out processes including a first wire drawing process, a first heat treatment process, a second wire drawing process, a second heat treatment process and an aging heat treatment process in this order, wherein the second heat treatment process is a solution heat treatment which, after heating to a first predetermined temperature within a range of 480° C. to 620° C., cools at an average cooling rate of greater than or equal to 10° C./s, and the annealing heat treatment includes a first annealing step of heating to a second predetermined temperature within a range of higher than or equal to 80° C. and lower than 150° C. and thereafter retaining at the second predetermined temperature, and a second annealing step of heating to a third predetermined temperature within a range of 140° C. to 250° C. and thereafter retaining at the third predetermined temperature, the third predetermine temperature being higher than the second predetermined temperature.

The aluminum alloy wire rod of the present disclosure is based on a prerequisite to use an aluminum alloy containing Mg and Si, and by making a precipitate free zone (PFZ) appropriate, which is formed at a portion of a grain that is inside the grain and located in the vicinity of a grain boundary, particularly when used as an extra fine wire having a strand diameter of less than or equal to 0.5 mm, an aluminum alloy wire rod used as a conductor of an electric wiring structure, an aluminum alloy stranded wire, a coated wire, a wire harness, and a method of manufacturing an aluminum alloy wire rod can be provided with an improved impact resistance and bending fatigue resistance while ensuring strength, elongation and conductivity equivalent to those of a product of the related art (aluminum alloy wire disclosed in Japanese Laid-Open Patent Publication No. 2012-229485), and thus it is useful as a conducting wire for a motor, a battery cable, or a harness equipped on a transportation vehicle, and as a wiring structure of an industrial robot. Particularly, since an aluminum alloy wire of the present disclosure has a high tensile strength, a wire size thereof can be made smaller than that of the wire of the related art, and it can be appropriately used for a door, a trunk, a hood or an engine room requiring a high impact resistance and bending fatigue resistance.

DETAILED DESCRIPTION

Figure 1:
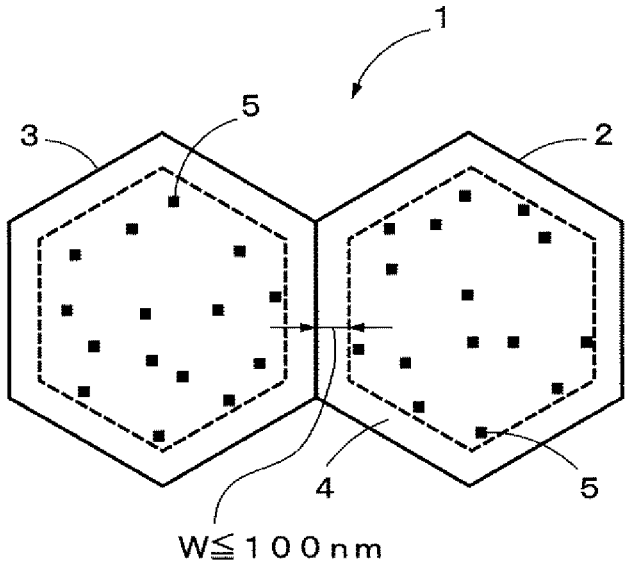
FIG. 1 is a diagram conceptually showing a width of PFZ and a distribution state of precipitates of Si and Mg (e.g., an $Mg_2Si$ precipitate) by observing and extracting only two crystal grains from a microstructure of an aluminum alloy wire of the present disclosure.

An aluminum alloy wire rod of the present disclosure has a composition consisting of 0.10 mass % to 1.00 mass % Mg; 0.10 mass % to 1.00 mass % Si; 0.01 mass % to 1.40 mass % Fe; 0.000 mass % to 0.100 mass % Ti; 0.000 mass % to 0.030 mass % B; 0.00 mass % to 1.00 mass % Cu; 0.00 mass % to 0.50 mass % Ag; 0.00 mass % to 0.50 mass % Au; 0.00 mass % to 1.00 mass % Mn; 0.00 mass % to 1.00 mass % Cr; 0.00 mass % to 0.50 mass % Zr; 0.00 mass % to 0.50 mass % Hf; 0.00 mass % to 0.50 mass % V; 0.00 mass % to 0.50 mass % Sc; 0.00 mass % to 0.50 mass % Co; 0.00 mass % to 0.50 mass % Ni; and the balance being Al and incidental impurities, wherein at least one of Ti, B, Cu, Ag, Au, Mn, Cr, Zr, Hf, V, Sc, Co and Ni is contained in the composition or none of Ti, B, Cu, Ag, Au, Mn, Cr, Zr, Hf, V, Sc, Co and Ni is contained in the composition, a precipitate free zone exists inside a crystal grain, and the precipitate free zone has a width of less than or equal to 100 nm.

Hereinafter, reasons for limiting chemical compositions or the like of the aluminum alloy wire of the present disclosure will be described.

(1) Chemical Composition

<Mg: 0.10 Mass % to 1.00 Mass %>

Mg (magnesium) is an element having a strengthening effect by forming a solid solution with an aluminum base material and a part thereof having an effect of improving a tensile strength, an impact resistance, a bending fatigue resistance and a heat resistance by being combined with Si to form precipitates. However, in a case where Mg content is less than 0.10 mass %, the above effects are insufficient. In a case where Mg content exceeds 1.00 mass %, there is an increased possibility of precipitation of Mg at a grain boundary, thus causing broadening of a PFZ width and resulting in decreased tensile strength, elongation, impact resistance and bending fatigue resistance, as well as a reduced conductivity due to an increased amount of Mg element forming the solid solution. Accordingly, the Mg content is 0.10 mass % to 1.00 mass %. The Mg content is, when a high strength is of importance, preferably 0.50 mass % to 1.00 mass %, and in case where a conductivity is of importance, preferably 0.10 mass % to 0.50 mass %. Based on the points described above, 0.30 mass % to 0.70 mass % is generally preferable.

<Si: 0.10 Mass % to 1.00 Mass %>

Si (silicon) is an element that has an effect of improving a tensile strength, an impact resistance, a bending fatigue resistance and a heat resistance by being combined with Mg to form precipitates. However, in a case where Si content is less than 0.10 mass %, the above effects are insufficient. In a case where Si content exceeds 1.00 mass %, there is an increased possibility that an Si-concentration part will be precipitated on a grain boundary, thus causing broadening of a PFZ width and resulting in decreased tensile strength, elongation, impact resistance and fatigue resistance, as well as a reduced conductivity due to an increased amount of Si element forming the solid solution. Accordingly, the Si content is 0.10 mass % to 1.00 mass %. The Si content is, when a high strength is of importance, preferably 0.50 mass % to 1.00 mass %, and in case where a conductivity is of importance, preferably 0.10 mass % to 0.50 mass %. Based on the points described above, 0.30 mass % to 0.70 mass % is generally preferable.

<Fe: 0.01 Mass % to 1.40 Mass %>

Fe (iron) is an element that contributes to refinement of crystal grains mainly by forming an Al—Fe based intermetallic compound and provides improved tensile strength, impact resistance and bending fatigue resistance. Fe dissolves in Al only by 0.05 mass % at 655° C. and even less at room temperature. Accordingly, the remaining Fe that could not dissolve in Al will be crystallized or precipitated as an intermetallic compound such as Al—Fe, Al—Fe—Si, and Al—Fe—Si—Mg. This intermetallic compound contributes to refinement of crystal grains and provides improved tensile strength, impact resistance and bending fatigue resistance. Further, Fe has, also by Fe that has dissolved in Al, an effect of providing an improved tensile strength. In a case where Fe content is less than 0.01 mass %, those effects are insufficient. In a case where Fe content exceeds 1.40 mass %, a wire drawing workability worsens due to coarsening of crystallized materials or precipitates. As a result, a target impact resistance and bending fatigue resistance cannot be achieved and also a conductivity decreases. Therefore, Fe content is 0.01 mass % to 1.40 mass %, and preferably 0.15 mass % to 0.90 mass %, and more preferably 0.15 mass % to 0.45 mass %.

The aluminum alloy wire rod of the present disclosure includes Mg, Si and Fe as essential components, and may further contain at least one selected from a group consisting of Ti and B, and/or at least one selected from a group consisting of Cu, Ag, Au, Mn, Cr, Zr, Hf, V, Sc, Co and Ni, as necessary.

<Ti: 0.001 Mass % to 0.100 Mass %>

Ti is an element having an effect of refining the structure of an ingot during dissolution casting. In a case where an ingot has a coarse structure, the ingot may crack during casting or a wire break may occur during a wire rod processing step, which is industrially undesirable. In a case where Ti content is less than 0.001 mass %, the aforementioned effect cannot be achieved sufficiently, and in a case where Ti content exceeds 0.100 mass %, the conductivity tends to decrease. Accordingly, the Ti content is 0.001 mass % to 0.100 mass %, preferably 0.005 mass % to 0.050 mass %, and more preferably 0.005 mass % to 0.030 mass %.

<B: 0.001 Mass % to 0.030 Mass %>

Similarly to Ti, B is an element having an effect of refining the structure of an ingot during dissolution casting. In a case where an ingot has a coarse structure, the ingot may crack during casting or a wire break occurs during a wire rod processing step, which is industrially undesirable. This is because in a case where B content is less than 0.001 mass %, the aforementioned effect cannot be achieved sufficiently, and in a case where B content exceeds 0.030 mass %, the conductivity tends to decrease. Accordingly, the B content is 0.001 mass % to 0.030 mass %, preferably 0.001 mass % to 0.020 mass %, and more preferably 0.001 mass % to 0.010 mass %.

To contain at least one of <Cu: 0.01 mass % to 1.00 mass %>, <Ag: 0.01 mass % to 0.50 mass %>, <Au: 0.01 mass % to 0.50 mass %>, <Mn: 0.01 mass % to 1.00 mass %>, <Cr: 0.01 mass % to 1.00 mass %>, <Zr: 0.01 mass % to 0.50 mass %>, <Hf: 0.01 mass % to 0.50 mass %>, <V: 0.01 mass % to 0.50 mass %>, <Sc: 0.01 mass % to 0.50 mass %>, <Co: 0.01 mass % to 0.50 mass %>, and <Ni: 0.01 mass % to 0.50 mass %>.

Each of Cu, Ag, Au, Mn, Cr, Zr, Hf, V, Sc, Co and Ni is an element having an effect of refining crystal grains, and Cu, Ag and Au are elements further having an effect of increasing a grain boundary strength by being precipitated at a grain boundary. In a case where at least one of the elements described above is contained by 0.01 mass % or more, the aforementioned effects can be achieved and a tensile strength, an elongation, an impact resistance and a bending fatigue resistance can be further improved. On the other hand, in a case where any one of Cu, Ag, Au, Mn, Cr, Zr, Hf, V, Sc, Co and Ni has a content exceeding the upper limit thereof mentioned above, a wire break is likely to occur since a compound containing the said elements coarsens and deteriorates wire drawing workability, and also a conductivity tends to decrease. Therefore, ranges of contents of Cu, Ag, Au, Mn, Cr, Zr, Hf, V, Sc, Co and Ni are the ranges described above, respectively.

The more the contents of Fe, Ti, B, Cu, Ag, Au, Mn, Cr, Zr, Hf, V, Sc, Co and Ni, the lower the conductivity tends to be and the more the wire drawing workability tends to deteriorate. Therefore, it is preferable that a sum of the contents of the elements is less than or equal to 2.00 mass %. With the aluminum alloy wire rod of the present disclosure, since Fe is an essential element, the sum of contents of Fe, Ti, B, Cu, Ag, Au, Mn, Cr, Zr, Hf, V, Sc, Co and Ni is 0.01 mass % to 2.00 mass %. It is further preferable that the sum of contents of these elements is 0.10 mass % to 2.00 mass %. In a case where the above elements are added alone, the compound containing the element tends to coarsen more as the content increases. Since this may degrade wire drawing workability and a wire break is likely to occur, ranges of content of the respective elements are as specified above.

In order to improve the tensile strength, the elongation, the impact resistance and the bending fatigue resistance while maintaining a high conductivity, the sum of contents of Fe, Ti, B, Cu, Ag, Au, Mn, Cr, Zr, Hf, V, Sc, Co and Ni is particularly preferably 0.10 mass % to 0.80 mass %, and further preferably 0.20 mass % to 0.60 mass %. On the other hand, in order to further improve the tensile strength, the elongation, the impact resistance and the bending fatigue resistance, although the conductivity will slightly decrease, it is particularly preferably more than 0.80 mass % to 2.00 mass %, and further preferably 1.00 mass % to 2.00 mass %.

<Balance: Al and Incidental Impurities>

The balance, i.e., components other than those described above, includes Al (aluminum) and incidental impurities. Herein, incidental impurities means impurities contained by an amount which could be contained inevitably during the manufacturing process. Since incidental impurities could cause a decrease in conductivity depending on a content thereof, it is preferable to suppress the content of the incidental impurities to some extent considering the decrease in the conductivity. Components that may be incidental impurities include, for example, Ga, Zn, Bi, and Pb.

(2) Width of Precipitate Free Zone (PFZ) Formed Inside a Grain is Less than or Equal to 100 nm The aluminum alloy wire rod of the present disclosure is, based on the prerequisite that it has the aforementioned chemical composition, capable of improving impact resistance and bending fatigue resistance while ensuring strength, elongation and conductivity of levels equivalent to those of the product of the related art (aluminum alloy wire as claimed in Japanese Laid-Open Patent Publication No. 2012-229485) by controlling a width of a precipitate free zone (PFZ) formed at a portion of a grain that is inside the grain and located in the vicinity of a grain boundary.

Figure 2:
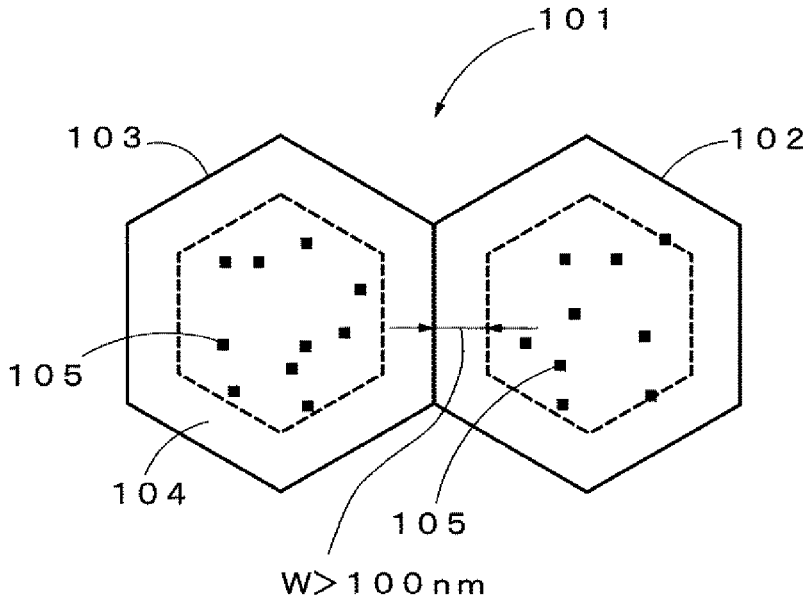
FIG. 2 is a diagram conceptually showing a width of PFZ and a distribution state of precipitates of Si and Mg (e.g., an $Mg_2Si$ precipitate) by observing and extracting only two crystal grains from a microstructure of an aluminum alloy wire of the related art.

It is an essential matter to specify the invention that a precipitate free zone (PFZ) exists at the portion of the grain that is inside the grain and located in the vicinity of the grain boundary, and that the precipitate free zone has a width of less than or equal to 100 nm. FIG. 1 is a diagram conceptually showing a width W of PFZ 4 and a distribution state of precipitates of Si and Mg (e.g., an $Mg_2Si$ precipitate 5) by observing and extracting only two crystal grains 2, 3 in an aluminum parent phase from a microstructure 1 of an aluminum alloy wire of the present disclosure. FIG. 2 is a diagram conceptually showing a width W of PFZ 104 and a distribution state of precipitates of Si and Mg (e.g., an $Mg_2Si$ precipitate 105) by observing and extracting only two crystal grains 102, 103 from a microstructure 101 of an aluminum alloy wire of the related art.

In the aluminum alloy wire rod of the present disclosure, a compound including Fe, Ti, B, Cu, Ag, Au, Mn, Cr, Zr, Hf, V, Sc, Co and Ni precipitates at the grain boundary, and, along with this, it becomes difficult for the concentration part of the Si element and the concentration part of the Mg element (e.g., $Mg_2Si$ precipitate 5) to be formed at the grain boundary, and, as a result, as shown in FIG. 1, the width W of the aforementioned precipitate free zone (PFZ) can be provided so as to be less than or equal to 100 nm, and impact resistance and bending fatigue resistance can be improved while ensuring strength, elongation and conductivity equivalent to those of the product of the related art (aluminum alloy wire disclosed in Japanese Laid-Open Patent Publication No. 2012-229485).

On the other hand, as shown in FIG. 2, in a case where the width W of the precipitate free zone (PFZ) 104 is greater than 100 nm, a tensile strength, an elongation, an impact resistance and a bending fatigue resistance will decrease. Therefore, in the present disclosure, the width W of the precipitate free zone (PFZ) 4 was limited to a range of less than or equal to 100 nm. Note that the narrower the width W of the precipitate free zone (PFZ) 4, the more the tensile strength, the elongation, the impact resistance and the bending fatigue resistance tend to improve. Accordingly, the width W is preferably less than or equal to 80 nm, and more preferably less than or equal to 60 nm. The precipitate free zone (PFZ) is a range from a grain boundary position to a border position between a region where precipitates exist (precipitate zone) and a region where precipitates do not exist (precipitate free zone). Therefore, the fact that PFZ does not exist means that precipitates do not exist. Since an acicular $Mg_2Si$ compound that is a precipitate has an effect of improving tensile strength, impact resistance, and bending fatigue resistance, it is preferable that the precipitate free zone (PFZ) has a width of at least greater than or equal to 1 nm.

Note that, in the present disclosure, the width W of PFZ 4 was calculated as follows. That is, a sample was observed using a transmission electron microscope while inclining the sample so that a grain boundary stands vertically with respect to a viewing direction, and two field of views where imaged as transmission electron microscope photographs at a magnification of 50,000× to 600,000×. The width W of PFZ 4 was measured at five positions per field of view, and an average of a total of ten positions was taken as a width of PFZ. At this time, PFZs 4 were observed on both sides of the grain boundary, and without being limited to measurements on one side of the grain boundary, PFZs 4 at arbitrary portions on both sides of the grain boundary were selected and widths W were measured and an average was taken. Note that, the width W of PFZ 4 as used herein means a range from a grain boundary position to a border position between a region where precipitates exist (precipitate zone) and a region where precipitates do not exist (precipitate free zone).

Such an aluminum alloy wire rod in which the width W of PFZ 4 is limited can be obtained by a combining control of alloy composition and a manufacturing process. A description is now made of a preferred manufacturing method of the aluminum alloy wire rod of the present disclosure.

(Manufacturing Method of the Aluminum Alloy Wire Rod of the Present Disclosure)

The aluminum alloy wire rod of the present disclosure can be manufactured with a manufacturing method including sequentially performing each of the processes including [1] melting, [2] casting, [3] hot working (e.g., grooved roller processing), [4] first wire drawing, [5] first heat treatment, [6] second wire drawing, [7] second heat treatment, and [8] aging heat treatment. Note that a stranding step may be provided before or after the second heat treatment or after the aging heat treatment, and a wire resin-coating step may be provided before or after the aging heat treatment. Hereinafter, steps of [1] to [8] will be described.

[1] Melting

Melting is performed while adjusting the quantities of each component to obtain an aluminum alloy composition described above.

[2] Casting and [3] Hot Working (e.g., Groove Roller Process)

Subsequently, using a Properzi-type continuous casting rolling mill which is an assembly of a casting wheel and a belt, molten metal is cast with a water-cooled mold and continuously rolled to obtain a bar having an appropriate size of, for example, ϕ5.0 mm to 13.0 mm. A cooling rate during casting at this time is, in regard to preventing coarsening of Fe-based crystallized products and preventing a decrease in conductivity due to forced solid solution of Fe, preferably 1° C./s to 20° C./s, but it is not limited thereto. Casting and hot rolling may be performed by billet casting and an extrusion technique.

[4] First Wire Drawing

Subsequently, the surface is stripped and the bar is made into an appropriate size of, for example, ϕ5.0 mm to 12.5 mm, and wire drawing is performed by cold rolling. It is preferable that a reduction ratio η is within a range of 1 to 6. The reduction ratio η is represented by:

$$\eta=\ln(A0/A1),$$

where A0 is a wire rod cross sectional area before wire drawing and A1 is a wire rod cross sectional area after wire drawing.

In a case where the reduction ratio η is less than 1, in a heat processing of a subsequent step, a recrystallized particle coarsens and a tensile strength and an elongation significantly decreases, which may cause a wire break. In a case where the reduction ratio η is greater than 6, the wire drawing becomes difficult and may be problematic from a quality point of view since a wire break might occur during a wire drawing process. The stripping of the surface has an effect of cleaning the surface, but does not need to be performed.

[5] First Heat Treatment (Intermediate Heat Treatment)

A first heat treatment is applied on the cold-drawn work piece. The first heat treatment is an intermediate heat treatment that is performed during the drawing process and its main purpose is to remove strain introduced in the first wire drawing. With this, a wire drawing workability of a wire rod in a second wire drawing performed subsequent to the first heat treatment can be improved. The condition of the first heat treatment is not particularly limited, but for example, in a batch heat treatment, the heating temperature is 300° C. to 500° C., and the heating time is 0.5 h to 10 h.

A method of performing the first heat treatment may be, for example, batch heat treatment or may be continuous heat treatment such as high-frequency heating, conduction heating, and running heating.

[6] Second Wire Drawing

After the aforementioned first heat treatment, a wire drawing is further applied as a cold working process. At this time, it is preferable that a reduction ratio η is within a range of 1 to 6. The reduction ratio has a significant effect on formation and growth of recrystallized grains. If the reduction ratio η is less than 1, recrystallized grains coarsen in the heat treatment of the subsequent step, and the tensile strength and elongation tend to decrease significantly. On the other hand, in a case where the reduction ratio n is greater than 6, wire drawing will be difficult and tends to cause a problem in quality such as a wire break during wire drawing.

[7] Second Heat Treatment (Solution Heat Treatment)

The second heat treatment is performed on the cold-drawn work piece. The manufacturing method of an aluminum alloy wire of the present disclosure is directed to performing, particularly, the second heat treatment and the aging heat treatment appropriately. The second heat treatment is a solution heat treatment to dissolve randomly contained compounds of Mg and Si into an aluminum parent phase, and specifically, includes heating to a first predetermined temperature in a range of 480° C. to 620° C. and thereafter cooling at an average cooling rate of greater than or equal to 10° C./s. When the first predetermined temperature in the second heat treatment is higher than 620° C., tensile strength, elongation, impact resistance and bending fatigue resistance decrease by eutectic melting. When the first predetermined temperature is lower than 480° C., the solution treatment cannot be achieved sufficiently, and an effect of improving the tensile strength in the subsequent annealing heat treatment process cannot be obtained sufficiently, and the tensile strength decreases. When the average cooling rate is less than 10° C./s, precipitates such as Mg and Si will be produced during the cooling, and the effect of improving the tensile strength in the subsequent annealing heat treatment process will be limited and there is a tendency that a sufficient strength is not obtained. The average cooling rate is preferably greater than or equal to 50° C./s, and more preferably 100° C./s. The predetermined temperature is in a range of 480° C. to 620° C., and preferably in a range of 500° C. to 600° C., more preferably in a range of 520° C. to 580° C.

Similarly to the first heat treatment, a method of performing the second heat treatment may be, for example, batch annealing or may be continuous annealing such as high-frequency heating, conduction heating, and running heating.

In a case where high-frequency heating and conduction heating are used, a wire rod temperature increases with a passage of time, since it normally has a structure in which electric current continues flowing through the wire rod. Accordingly, since the wire rod may melt when an electric current continues flowing through, it is necessary to perform heat treatment in an appropriate time range. In a case where running heating is used, since it is an annealing in a short time, the temperature of a running annealing furnace is usually set higher than the wire rod temperature. Since the wire rod may melt with a heat treatment over a long time, it is necessary to perform heat treatment in an appropriate time range. Also, all heat treatments require at least a predetermined time period in which Mg and Si compounds contained randomly in the work piece will be dissolved into an aluminum parent phase. Hereinafter, the heat treatment by each method will be described.

The continuous heat treatment by high-frequency heating is a heat treatment by joule heat generated from the wire rod itself by an induced current by the wire rod continuously passing through a magnetic field caused by a high frequency. Steps of rapid heating and rapid cooling are included, and the wire rod can be heat-treated by controlling the wire rod temperature and the heat treatment time. The cooling is performed after rapid heating by continuously allowing the wire rod to pass through water or in a nitrogen gas atmosphere. This heat treatment time is 0.01 s to 2 s, preferably 0.05 s to 1 s, and more preferably 0.05 s to 0.5 s.

The continuous conducting heat treatment is a heat treatment by joule heat generated from the wire rod itself by allowing an electric current to flow in the wire rod that continuously passes two electrode wheels. Steps of rapid heating and rapid cooling are included, and the wire rod can be heat-treated by controlling the wire rod temperature and the heat treatment time. The cooling is performed after rapid heating by continuously allowing the wire rod to pass through water, atmosphere or a nitrogen gas atmosphere. This heat treatment time period is 0.01 s to 2 s, preferably 0.05 s to 1 s, and more preferably 0.05 s to 0.5 s.

A continuous running heat treatment is a heat treatment in which the wire rod continuously passes through a heat treatment furnace maintained at a high-temperature. Steps of rapid heating and rapid cooling are included, and the wire rod can be heat-treated by controlling the temperature in the heat treatment furnace and the heat treatment time. The cooling is performed after rapid heating by continuously allowing the wire rod to pass through water, atmosphere or a nitrogen gas atmosphere. This heat treatment time period is 0.5 s to 120 s, preferably 0.5 s to 60 s, and more preferably 0.5 s to 20 s.

The batch heat treatment is a method in which a wire rod is placed in an annealing furnace and heat-treated at a predetermined temperature setting and a setup time. The wire rod itself should be heated at a predetermined temperature for about several tens of seconds, but in industrial application, it is preferable to perform for more than 30 minutes to suppress uneven heat treatment on the wire rod. An upper limit of the heat treatment time is not particularly limited as long as there are five crystal grains when counted in a radial direction of a wire rod, but in industrial application, since productivity increases when performed in a short time, heat treatment is performed within ten hours, and preferably within six hours.

In a case where one or both of the wire rod temperature or the heat treatment time are lower than conditions defined above, a solution process will be incomplete and an amount of an $Mg_2Si$ precipitate produced in the aging heat treatment, which is a post-process, decreases. Thus, a range of improvement of tensile strength, impact resistance, bending fatigue resistance and conductivity decreases. In a case where one or both of the wire rod temperature and the annealing time are higher than conditions defined above, coarsening of crystal grains and also a partial fusion (eutectic fusion) of a compound phase in the aluminum alloy wire rod occur. Thus, the tensile strength and the elongation decrease, and a wire break is likely to occur when handling the wire rod.

For any of the heat treatment methods described above, the cooling in the second heat treatment of the present disclosure is preferably performed by heating the aluminum alloy wire rod after the second wire drawing to a predetermined temperature and thereafter allowing the wire rod to pass through water, but in such a case, the cooling rate is possible cannot be measured accurately. Thus, in such a case, in each of the heat treatment methods, assuming that an aluminum alloy wire rod is cooled to water temperature (approximately 20° C.) immediately after water cooling, a cooling rate calculated as described below was taken as an average cooling rate by water cooling after heating for each of the heat treatment methods. That is, in a batch heat treatment, from the perspective that it is important that a period of time in which 150° C. or above is maintained is within 40 seconds from the beginning of the cooling, the cooling rate is greater than or equal to (500−150)/40=8.75° C./s when it is heat-treated to 500° C., and greater than or equal to (600−150)/40=11.25° C./s when it is heat-treated to 600° C. In a continuous heat treatment by high-frequency heating, the cooling rate is 100° C./s or above, since it is a mechanism that, after heating, passes an aluminum alloy wire rod for a few to several meters at a wire speed of 100 m/min to 1500 m/min and thereafter water cools the aluminum alloy wire rod. In a continuous heat treatment by conduction heating, the cooling rate is 100° C./s or above, since it is a mechanism that, immediately after heating, water cools an aluminum alloy wire rod. In a continuous heat treatment by running heating, the cooling rate is 100° C./s or above, in a case of a mechanism that, immediately after heating, water cools an aluminum alloy wire rod at a wire speed of 10 m/min to 500 m/min, and in a case of a mechanism that, after heating, air cools while being passed for a few to several meters to a few to several tens of meters, assuming that the aluminum alloy wire rod is cooled to room temperature (approximately 20° C.) immediately after being wound up on a drum, depending on a length of section during air-cooling, and cooling of greater than or equal to approximately 10° C./s is possible. In any of the heat treatment methods, it is only necessary to rapidly cool to at least 150° C. from the perspective of achieving a purpose of solution heat treatment.

[8] Aging Heat Treatment

Subsequently, an aging heat treatment is applied. The aging heat treatment in the present disclosure includes a first aging step of heating to a second predetermined temperature within a range of higher than or equal to 80° C. and lower than 150° C. and thereafter retaining at the second predetermined temperature, and a second annealing step of heating to a third predetermined temperature within a range of 140° C. to 250° C. and thereafter retaining at the third predetermined temperature, the third predetermine temperature being higher than the second predetermined temperature. That is, with the aging heat treatment, in the first aging step, a compound including Fe and further selectively added one or two component(s) selected from a group consisting of Ti, B, Cu, Ag, Au, Mn, Cr, Zr, Hf, V, Sc, Co, and Ni is precipitated at the grain boundary, and thus a precipitation driving force of an Si element and an Mg element at the grain boundary decreases, and in a subsequent second aging step, the Mg element and the Si element in the vicinity of the grain boundary become difficult to be used for grain boundary precipitation. Therefore, since depletion of the Mg element and the Si element is inhibited in the vicinity of the grain boundary, it is possible to provide a precipitate free zone (PFZ) having a width of less than or equal to 100 nm. As a result, impact resistance and bending fatigue resistance can be improved while ensuring strength, elongation and conductivity at a level equivalent to those of the product of the related art (aluminum alloy wire disclosed in Japanese Laid-Open Patent Publication No. 2012-229485).

In the first aging step, in a case where the second predetermined temperature is lower than 80° C., aging precipitation of a compound including Fe and further selectively added one or two component(s) selected from a group consisting of Ti, B, Cu, Ag, Au, Mn, Cr, Zr, Hf, V, Sc, Co, and Ni becomes insufficient, and $Mg_2Si$ becomes easy to precipitate at the grain boundary in a subsequent second aging step, and as a result, there is a problem that the width of PFZ becomes greater than 100 nm. In a case where the second predetermined temperature is higher than or equal to 150° C., it falls into a precipitation temperature range of $Mg_2Si$, and thus $Mg_2Si$ becomes easy to be precipitated at the grain boundary, and, as a result, there is a problem that the width of PFZ becomes greater than 100 nm. The retention time at the second predetermined temperature varies with temperature and thus it is not particularly limited, but considering the productivity, it should be a short period of time (e.g., one minute or more), and preferably 15 hours or less, and further preferably 10 hours or less. Further, in the second aging step, in a case where the third predetermined temperature is lower than 140° C., an acicular $Mg_2Si$ precipitate cannot be precipitated sufficiently, and there is a problem that strength, impact resistance, bending fatigue resistance and conductivity tend to lack. In a case where the third predetermined temperature is higher than 250° C., the size of the $Mg_2Si$ precipitate increases, and the conductivity increases, but there is a problem that strength, impact resistance, and bending fatigue resistance tend to lack. The retention time at the third predetermined temperature varies with temperature and thus it is not particularly limited, but considering the productivity, it should be a short period of time (e.g., one minute or more), and preferably 15 hours or less, and further preferably 10 hours or less. Therefore, in the present disclosure, the annealing heat treatment includes a first annealing step of heating to a second predetermined temperature within a range of higher than or equal to 80° C. and lower than 150° C. and thereafter retaining at the second predetermined temperature, and a second annealing step of heating to a third predetermined temperature within a range of 140° C. to 250° C. and thereafter retaining at the third predetermined temperature, the third predetermine temperature being higher than the second predetermined temperature. Also, the first aging step and the second aging step may be performed continuously, or the second aging step may be performed from a condition which is brought back to room temperature after finishing the first step. This is because the purpose is to cause precipitation of a compound which can be precipitated by retaining at a predetermined temperature range for a certain time in each aging step. Note that, regarding the cooling in the first and second aging steps, the cooling rate is preferably as fast as possible. However, in a manufacturing process, in a case where a rapid cooling is not possible, cooling in a heat treat furnace (gradual cooling) or cooling in the atmosphere (air-cooling) may be performed.

A strand diameter of the aluminum alloy wire of the present disclosure is not particularly limited and can be determined as appropriate depending on an application, and it is preferably ϕ0.1 mm to 0.5 mm for a fine wire, and ϕ0.8 mm to 1.5 mm for a case of a middle sized wire. The present aluminum alloy wire rod has an advantage in that it can be used as a thin single wire as an aluminum alloy wire, but may also be used as an aluminum alloy stranded wire obtained by stranding a plurality of them together, and among the aforementioned steps [1] to [8] of the manufacturing method of the present disclosure, after bundling and stranding a plurality of aluminum alloy wires obtained by sequentially performing each of steps [1] to [7], the step of [8] aging heat treatment may be performed.

Also, in the present disclosure, homogenizing heat treatment performed in the prior art may be performed as a further additional step after the continuous casting rolling. Since a homogenizing heat treatment can uniformly disperse precipitates (mainly Mg—Si based compound) of the added element, it becomes easy to obtain a uniform crystal structure in the subsequent first heat treatment, and as a result, improvement in a tensile strength, an elongation, an impact resistance, and a bending fatigue resistance can be obtained more stably. The homogenizing heat treatment is preferably performed at a heating temperature of 450° C. to 600° C. and a heating time of 1 to 10 hours, and more preferably 500° C. to 600° C. Also, as for the cooling in the homogenizing heat treatment, a slow cooling at an average cooling rate of 0.1° C./min to 1.0° C./min is preferable since it becomes easier to obtain a uniform compound.

Note that the above description merely indicates an example of an embodiment of the present disclosure and can add various modification may be added to the claims. For example, the aluminum alloy wire of the present disclosure has an impact absorption energy of greater than or equal to 5 $J/mm^2$, and can achieve an improved impact resistance. Further, a number of cycles to fracture measured by a bending fatigue test is 200,000 times or more, and can achieve an improved bending fatigue resistance. Also, the aluminum alloy wire of the present disclosure can be used as an aluminum alloy wire, or as an aluminum alloy stranded wire obtained by stranding a plurality of aluminum alloy wires, and may also be used as a coated wire having a coating layer at an outer periphery of the aluminum alloy wire or the aluminum alloy stranded wire, and, in addition, it can also be used as a wire harness having a coated wire and a terminal fitted at an end portion of the coated wire, the coating layer being removed from the end portion.

EXAMPLE

The present disclosure will be described in detail based on the following examples. Note that the present disclosure is not limited to examples described below.

Examples and Comparative Examples

Using a Properzi-type continuous casting rolling mill, molten metal containing Mg, Si, Fe and Al, and selectively added Ti, B, Cu, Ag, Au, Mn, Cr, Zr, Hf, V, Sc, Co and Ni, with contents (mass %) shown in Tables 1-1, 1-2, and 2 is cast with a water-cooled mold and rolled into a bar of ϕ9.5 mm. A casting cooling rate at this time was approximately 15° C./s. Then, a first wire drawing was carried out to obtain a predetermined reduction ratio. Then, a first heat treatment was performed with conditions indicated in Tables 3-1, 3-2 and 4 on a work piece subjected to the first wire drawing, and further, a second wire drawing was performed until a wire size of ϕ0.31 mm was obtained and such that a predetermined reduction ratio is obtained. Then, a second heat treatment was applied under conditions shown in Tables 3-1, 3-2 and 4. In both of the first and second heat treatments, in a case of a batch heat treatment, a wire rod temperature was measured with a thermocouple wound around the wire rod. In a case of continuous conducting heat treatment, since measurement at a part where the temperature of the wire rod is the highest is difficult due to the facility, the temperature was measured with a fiber optic radiation thermometer (manufactured by Japan Sensor Corporation) at a position upstream of a portion where the temperature of the wire rod becomes highest, and a maximum temperature was calculated in consideration of joule heat and heat dissipation. In a case of high-frequency heating and consecutive running heat treatment, a wire rod temperature in the vicinity of a heat treatment section outlet was measured. After the second heat treatment, an aging heat treatment was applied under conditions shown in Tables 3-1, 3-2 and 4 to produce an aluminum alloy wire. Note that Comparative Examples 11 and 13 were also evaluated since they have compositions of sample Nos. 2 and 10, respectively, in Table 1 in Japanese Laid-Open Patent Publication No. 2012-229485 and an aluminum alloy wire was produced with a manufacturing method equivalent to the manufacturing method disclosed in Japanese Laid-Open Patent Publication No. 2012-229485.

For each of aluminum alloy wires of the Example and the Comparative Example, each characteristic was measured by methods shown below. The results are shown in Tables 3-1, 3-2 and 4.

(a) Measurement of Precipitate Free Zone (PFZ) Formed at a Portion of Grain that is Inside the Grain and Located in the Vicinity of a Grain Boundary In the present disclosure, the width W of the PFZ 4 was calculated as follows. That is, a sample was observed using a transmission electron microscope while inclining the sample so that a grain boundary stands vertically with respect to a viewing direction, and two field of views where imaged as transmission electron microscope photographs at a magnification of 50,000× to 600,000×. The width W of PFZ 4 was measured at five positions per field of view, and an average of a total of ten positions was taken as a width of PFZ. At this time, PFZs 4 were observed on both sides of the grain boundary, and without being limited to measurements on one side of the grain boundary, PFZs 4 at arbitrary portions on both sides of the grain boundary were selected and widths W were measured and an average was taken.

(b) Measurement of Tensile Strength (TS) and Flexibility (Elongation after Fracture)

In conformity with JIS Z2241, a tensile test was carried out for three materials under test (aluminum alloy wires) each time, and an average value thereof was obtained. The tensile strength of greater than or equal to 135 MPa was regarded as a pass level so as to keep the tensile strength of a crimp portion at a connection portion between an electric wire and a terminal and to withstand a load abruptly applied during an installation work to a car body. As for the elongation, greater than or equal to 5% was regarded as a pass level.

(c) Conductivity (EC)

In a constant temperature bath in which a test piece of 300 mm in length is held at 20° C. (±0.5° C.), a resistivity was measured for three materials under test (aluminum alloy wires) each time using a four terminal method, and an average conductivity was calculated. The distance between the terminals was 200 mm. The conductivity is not particularly prescribed, but those greater than or equal to 40% IACS was regarded as a pass.

(d) Impact Absorption Energy

It is an index showing how much impact the aluminum alloy wire rod can withstand which is calculated by (potential energy of weight)/(cross sectional area of aluminum alloy wire rod) immediately before a wire break of the aluminum alloy wire rod. Specifically, a weight was attached to one end of the aluminum alloy wire rod wire and the weight was allowed to fall freely from a height of 300 mm. The weight was changed into a heavier weight sequentially, and the impact absorption energy was calculated from the weight immediately before a wire break. It can be said that the larger the impact absorption energy is, the higher the impact absorption. As for the impact absorption energy, 5 J/cm$^2$ or higher was regarded as a pass level.

(e) Number of Cycles to Fracture

As a reference of the bending fatigue resistance, a strain amplitude at an ordinary temperature is assumed as ±0.17%. The bending fatigue resistance varies depending on the strain amplitude. In a case where the strain amplitude is large, a fatigue life decreases, and in a case where the strain amplitude is small, the fatigue life increases. Since the strain amplitude can be determined by a wire size of the wire rod and a radius of curvature of a bending jig, a bending fatigue test can be carried out with the wire size of the wire rod and the radius of curvature of the bending jig being set arbitrarily. With a reversed bending fatigue tester manufactured by Fujii Seiki Co., Ltd. (existing company Fujii Co., Ltd.) and using a jig that can give a 0.17% bending strain, a repeated bending was carried out and a number of cycles to fracture was measured. In the present disclosure, number of cycles to fracture of 200,000 times or more was regarded as a pass.

(f) Terminal Crimp Portion Strength

Immediately before the second heat treatment, eleven wires of the aluminum alloy wire rod of ϕ0.31 mm were stranded together. Then the second heat treatment and the aging heat treatment shown in Tables 3-1, 3-2 and 4 were applied and an aluminum alloy stranded wire was manufactured. Further, a coating layer was applied to an outer periphery of this aluminum alloy stranded wire to provide a coated wire. The coating layer at both ends of the coated wire was removed. A terminal was fitted at one end of the coated wire and the other end was chucked, and a tensile test was performed at room temperature. As a result, a tensile fracture strength of the electric wire fitted with a terminal was obtained. This was taken as a terminal crimp portion strength. A test was carried out by making a measurement for each of the three wires and calculating an average value. The terminal was fitted by crimping by swaging, but any crimping method may be employed. A terminal compressibility was 0.65. The terminal crimp portion strength of greater than or equal to 80N was regarded as an acceptable level.

TABLE 1-1

| | | COMPOSITION (MASS %) | | | | | | | | | | | | | | | | |
|---|---|---|---|---|---|---|---|---|---|---|---|---|---|---|---|---|---|---|
| | No. | Mg | Si | Fe | Au | Ag | Cu | Cr | Mn | Zr | Ti | B | Hf | V | Sc | Co | Ni | Al |
| EXAMPLE | 1 | 0.34 | 0.34 | 0.20 | — | — | — | — | — | — | 0.010 | 0.003 | — | — | — | — | — | BALANCE |
| | 2 | 0.45 | 0.51 | 0.20 | — | — | 0.20 | — | — | — | 0.010 | 0.003 | — | — | — | — | — | |
| | 3 | 0.64 | 0.64 | 0.20 | — | — | — | 0.20 | — | — | 0.010 | 0.003 | — | — | — | — | — | |
| | 4 | 0.64 | 0.47 | 0.10 | — | — | — | — | 0.20 | — | 0.010 | 0.003 | — | — | — | — | — | |
| | 5 | 0.55 | 0.55 | 0.20 | — | — | — | — | — | 0.10 | 0.010 | 0.003 | — | — | — | — | — | |
| | 6 | 0.77 | 0.57 | 0.02 | — | — | 0.10 | 0.10 | — | — | 0.010 | 0.003 | — | — | — | — | — | |
| | 7 | 0.34 | 0.39 | 0.20 | — | — | 0.10 | — | 0.40 | — | 0.010 | 0.006 | — | — | — | — | — | |

TABLE 1-1-continued

| | COMPOSITION (MASS %) | | | | | | | | | | | | | | | | |
|---|---|---|---|---|---|---|---|---|---|---|---|---|---|---|---|---|---|
| No. | Mg | Si | Fe | Au | Ag | Cu | Cr | Mn | Zr | Ti | B | Hf | V | Sc | Co | Ni | Al |
| 8 | 0.77 | 0.88 | 0.20 | — | — | 0.04 | — | — | 0.20 | 0.010 | 0.003 | — | — | — | — | — | |
| 9 | 0.55 | 0.41 | 0.20 | — | — | — | 0.10 | 0.10 | — | 0.005 | 0.003 | — | — | — | — | — | |
| 10 | 0.55 | 0.63 | 0.40 | — | — | — | 0.40 | — | 0.05 | 0.010 | 0.003 | — | — | — | — | — | |
| 11 | 0.77 | 0.77 | 0.20 | — | — | — | — | 0.20 | 0.10 | 0.010 | 0.003 | — | — | — | — | — | |
| 12 | 0.34 | 0.39 | 0.20 | — | — | 0.05 | 0.05 | 0.40 | — | 0.010 | 0.003 | — | — | — | — | — | |
| 13 | 0.45 | 0.33 | 0.80 | — | — | — | 0.10 | 0.05 | 0.20 | 0.020 | 0.003 | — | — | — | — | — | |
| 14 | 0.55 | 0.63 | 0.20 | — | — | 0.20 | — | 0.10 | 0.20 | 0.010 | 0.006 | — | — | — | — | — | |
| 15 | 0.64 | 0.73 | 0.20 | — | — | 0.10 | 0.10 | — | 0.10 | 0.010 | 0.003 | — | — | — | — | — | |
| 16 | 0.34 | 0.39 | 0.20 | — | — | — | 0.10 | — | — | — | — | — | — | — | — | — | |
| 17 | 0.45 | 0.45 | 0.20 | — | — | — | — | 0.20 | — | — | — | — | — | — | — | — | |
| 18 | 0.64 | 0.47 | 0.20 | 0.50 | — | — | — | — | 0.10 | 0.010 | 0.003 | — | — | — | — | — | |
| 19 | 0.64 | 0.47 | 0.20 | 0.11 | — | — | — | 0.20 | — | 0.010 | 0.012 | — | — | — | — | — | |
| 20 | 0.64 | 0.47 | 0.20 | — | 0.10 | — | — | — | 0.10 | 0.010 | 0.003 | — | — | — | — | — | |
| 21 | 0.64 | 0.47 | 0.20 | — | 0.20 | — | 0.20 | — | — | 0.010 | 0.003 | — | — | — | — | — | |
| 22 | 0.34 | 0.39 | 0.20 | 0.10 | — | 0.30 | — | — | 0.50 | 0.010 | 0.003 | — | — | — | — | — | |
| 23 | 0.64 | 0.47 | 0.20 | — | 0.50 | — | 0.10 | 0.20 | — | 0.010 | 0.003 | 0.10 | — | — | 0.10 | — | |
| 24 | 0.64 | 0.47 | 0.20 | — | — | 0.80 | — | — | — | 0.010 | 0.003 | — | — | 0.05 | — | — | |
| 25 | 0.55 | 0.63 | 0.80 | — | — | — | 0.50 | — | — | 0.010 | 0.003 | — | — | — | 0.20 | — | |
| 26 | 0.34 | 0.39 | 0.40 | — | — | 0.20 | — | 0.50 | 0.10 | 0.010 | 0.003 | — | — | — | — | 0.10 | |

N.B. NUMERICAL VALUES IN BOLD ITALIC IN THE TABLE ARE OUT OF APPROPRIATE RANGE OF THE EXAMPLE

TABLE 1-2

| | | COMPOSITION (MASS %) | | | | | | | | | | | | | | | | |
|---|---|---|---|---|---|---|---|---|---|---|---|---|---|---|---|---|---|---|
| | No. | Mg | Si | Fe | Au | Ag | Cu | Cr | Mn | Zr | Ti | B | Hf | V | Sc | Co | Ni | Al |
| EXAMPLE | 27 | 0.50 | 0.50 | 0.20 | — | — | — | — | — | — | 0.010 | 0.003 | — | — | — | — | — | BALANCE |
| | 28 | 0.50 | 0.50 | 0.20 | — | — | — | 0.20 | — | — | 0.020 | 0.005 | — | — | 0.20 | — | — | |
| | 29 | 0.50 | 0.50 | 0.20 | — | — | — | — | 0.20 | — | 0.020 | 0.005 | — | 0.30 | — | — | — | |
| | 30 | 0.50 | 0.50 | 0.20 | — | — | — | — | — | 0.20 | 0.020 | 0.005 | 0.20 | — | — | — | — | |
| | 31 | 0.36 | 0.34 | 0.10 | — | — | — | — | — | — | 0.005 | 0.001 | — | — | — | — | — | |
| | 32 | 0.34 | 0.34 | 0.10 | — | — | — | — | 0.05 | — | 0.005 | 0.001 | — | — | — | — | — | |
| | 33 | 0.40 | 0.33 | 0.20 | — | — | — | — | — | — | 0.010 | 0.003 | — | — | — | — | — | |
| | 34 | 0.40 | 0.33 | 0.05 | — | — | — | — | — | — | 0.010 | 0.003 | — | — | — | 0.05 | — | |
| | 35 | 0.40 | 0.33 | 0.01 | — | — | — | — | — | — | 0.010 | 0.003 | — | — | — | — | — | |
| | 36 | 0.50 | 0.50 | 0.10 | — | — | — | — | — | — | 0.010 | 0.003 | — | 0.05 | — | — | — | |
| | 37 | 0.50 | 0.50 | 0.20 | 0.20 | — | — | — | — | — | 0.010 | 0.003 | — | — | 0.05 | — | — | |
| | 38 | 0.50 | 0.50 | 0.20 | — | — | — | — | — | — | 0.010 | 0.003 | 0.05 | — | — | — | — | |
| | 39 | 0.64 | 0.47 | 0.20 | — | — | — | — | — | — | 0.010 | 0.003 | — | — | — | — | 0.05 | |
| | 40 | 0.55 | 0.63 | 0.20 | — | — | 0.20 | — | — | — | 0.010 | 0.003 | — | 0.20 | — | — | — | |
| | 41 | 0.64 | 0.47 | 0.20 | — | — | — | 0.10 | 0.10 | — | 0.010 | 0.003 | — | — | 0.10 | — | — | |
| | 42 | 0.50 | 0.50 | 0.20 | — | 0.10 | — | — | — | 0.10 | 0.010 | 0.003 | — | — | — | — | 0.2 | |
| | 43 | 0.64 | 0.47 | 0.20 | — | — | 0.10 | — | — | 0.10 | 0.010 | 0.003 | 0.10 | — | — | — | — | |
| | 44 | 0.55 | 0.63 | 0.20 | — | — | — | — | — | — | 0.010 | 0.003 | — | 0.01 | — | — | — | |
| | 45 | 0.55 | 0.63 | 0.20 | — | — | — | — | — | — | 0.010 | 0.003 | 0.01 | — | — | — | — | |
| | 46 | 0.55 | 0.63 | 0.20 | — | — | 0.05 | — | — | — | 0.010 | 0.003 | — | — | — | — | — | |
| | 47 | 0.55 | 0.63 | 0.20 | — | — | — | — | — | — | 0.010 | 0.003 | 0.20 | — | — | — | — | |
| | 48 | 0.55 | 0.63 | 0.20 | — | — | — | — | — | — | 0.010 | 0.003 | — | — | — | — | 0.3 | |
| | 49 | 0.50 | 0.50 | 1.00 | — | — | 0.10 | 0.20 | — | — | 0.010 | 0.003 | — | — | — | — | — | |
| | 50 | 0.50 | 0.50 | 1.20 | — | — | — | 0.10 | 0.10 | — | 0.010 | 0.003 | — | — | — | — | — | |
| | 51 | 0.50 | 0.50 | 1.40 | — | — | — | 0.05 | — | 0.10 | 0.010 | 0.003 | — | — | — | — | — | |
| | 52 | 1.00 | 1.00 | 0.20 | — | — | — | — | — | 0.05 | 0.010 | 0.003 | — | — | — | — | — | |

N.B. NUMERICAL VALUES IN BOLD ITALIC IN THE TABLE ARE OUT OF APPROPRIATE RANGE OF THE EXAMPLE

TABLE 2

| | | COMPOSITION (MASS %) | | | | | | | | | | | | | | | | |
|---|---|---|---|---|---|---|---|---|---|---|---|---|---|---|---|---|---|---|
| | No. | Mg | Si | Fe | Au | Ag | Cu | Cr | Mn | Zr | Ti | B | Hf | V | Sc | Co | Ni | Al |
| COMPARATIVE EXAMPLE | 1 | ***1.20*** | 0.39 | 0.20 | — | — | — | — | — | — | 0.010 | 0.003 | — | — | — | — | — | BALANCE |
| | 2 | ***0.05*** | 0.39 | 0.20 | — | — | — | — | — | — | 0.010 | 0.003 | — | — | — | — | — | |
| | 3 | 0.55 | ***1.20*** | 0.20 | — | — | — | — | 0.20 | — | 0.010 | 0.003 | — | — | — | — | — | |
| | 4 | 0.55 | ***0.05*** | 0.20 | — | — | — | — | 0.20 | — | 0.010 | 0.003 | — | — | — | — | — | |
| | 5 | 0.55 | 0.55 | ***1.50*** | — | — | — | — | — | — | 0.010 | 0.003 | — | — | — | — | — | |
| | 6 | 0.55 | 0.55 | 0.20 | — | — | — | — | — | ***0.60*** | 0.010 | 0.003 | ***0.60*** | — | — | — | — | |
| | 7 | 0.55 | 0.55 | 0.20 | — | — | — | — | ***1.20*** | — | 0.010 | 0.003 | — | — | — | — | — | |
| | 8 | 0.55 | 0.55 | 0.20 | — | — | — | ***1.20*** | — | — | 0.010 | 0.003 | — | — | — | — | — | |
| | 9 | 0.55 | 0.55 | 0.50 | 0.20 | — | 0.50 | 0.20 | 0.20 | — | 0.010 | 0.003 | — | 0.40 | 0.50 | — | — | |

TABLE 2-continued

| No. | COMPOSITION (MASS %) | | | | | | | | | | | | | | | | |
|---|---|---|---|---|---|---|---|---|---|---|---|---|---|---|---|---|---|
| | Mg | Si | Fe | Au | Ag | Cu | Cr | Mn | Zr | Ti | B | Hf | V | Sc | Co | Ni | Al |
| 10 | ***0.01*** | ***0.04*** | 0.21 | — | — | — | — | — | — | 0.010 | 0.003 | — | — | — | — | — | |
| 11 | 0.88 | 0.64 | 0.13 | — | — | — | — | 0.20 | — | 0.020 | 0.004 | — | — | — | — | — | |
| 12 | 0.51 | 0.41 | 0.15 | — | — | — | — | — | 0.07 | 0.010 | 0.002 | — | — | — | — | — | |
| 13 | 0.67 | 0.52 | 0.13 | — | — | — | 0.20 | — | — | 0.020 | 0.004 | — | — | — | — | — | |
| 14 | 0.51 | 0.41 | 0.15 | — | — | — | — | 0.20 | — | 0.020 | 0.004 | — | — | — | — | — | |
| 15 | 0.64 | 0.47 | 0.20 | — | 0.10 | 0.10 | — | — | — | 0.010 | 0.003 | — | — | — | — | — | |
| 16 | 0.64 | 0.47 | 0.20 | — | — | — | — | 0.10 | — | 0.010 | 0.003 | — | — | — | — | — | |
| 17 | 0.64 | 0.47 | 0.20 | — | — | — | — | — | 0.10 | 0.010 | 0.003 | — | — | — | — | — | |
| 18 | 0.64 | 0.47 | 0.20 | — | — | — | 0.20 | 0.10 | — | 0.010 | 0.003 | — | — | — | — | — | |

N.B. NUMERICAL VALUES IN BOLD ITALIC IN THE TABLE ARE OUT OF APPROPRIATE RANGE OF THE EXAMPLE

TABLE 3-1

| | | FIRST HEAT TREATEMENT | | SECOND HEAT TREATMENT | | AGING HEAT TREATMENT | | | | |
|---|---|---|---|---|---|---|---|---|---|---|
| | | | | | | FIRST AGING STEP | | SECOND AGING STEP | | |
| | | | | FIRST | | SECOND | | THIRD | | |
| | No. | HEATING TEMP. (° C.) | AVE. COOLING RATE (° C./s) | PREDETER-MINED TEMP. (° C.) | AVE. COOLING RATE (° C./s) | PREDETER-MINED TEMP. (° C.) | TIME (HOUR) | PREDETER-MINED TEMP. (° C.) | TIME (HOUR) | WIDTH OF PFZ (nm) |
| EXAMPLE | 1 | 400 | >=100 | 550 | >=100 | 100 | 5 | 150 | 5 | 14 |
| | 2 | 450 | >=101 | 550 | >=100 | 140 | 1 | 160 | 5 | 20 |
| | 3 | 400 | 0.3 | 550 | >=100 | 100 | 5 | 180 | 10 | 41 |
| | 4 | 400 | 0.3 | 550 | >=100 | 120 | 1 | 160 | 1 | 11 |
| | 5 | 400 | 0.3 | 550 | >=100 | 100 | 15 | 150 | 5 | 11 |
| | 6 | 350 | 0.3 | 550 | >=100 | 120 | 1 | 150 | 10 | 15 |
| | 7 | 350 | 0.3 | 520 | >=100 | 140 | 5 | 160 | 1 | 12 |
| | 8 | 350 | 0.3 | 520 | >=100 | 100 | 1 | 160 | 5 | 19 |
| | 9 | 350 | 0.3 | 550 | >=100 | 120 | 15 | 180 | 1 | 26 |
| | 10 | 300 | 0.3 | 550 | >=100 | 120 | 5 | 150 | 1 | 10 |
| | 11 | 300 | 0.3 | 600 | >=100 | 140 | 5 | 150 | 10 | 16 |
| | 12 | 300 | 0.3 | 600 | >=100 | 100 | 10 | 200 | 5 | 83 |
| | 13 | 300 | 0.3 | 580 | 42 | 120 | 5 | 160 | 15 | 26 |
| | 14 | 300 | 0.3 | 580 | 83 | 140 | 5 | 180 | 10 | 45 |
| | 15 | 300 | 0.3 | 550 | >=100 | 120 | 10 | 180 | 15 | 49 |
| | 16 | 300 | 0.3 | 550 | >=100 | 140 | 5 | 180 | 10 | 44 |
| | 17 | 300 | 0.3 | 550 | 10 | 120 | 1 | 150 | 5 | 17 |
| | 18 | 450 | 0.4 | 500 | >=100 | 120 | 10 | 200 | 15 | 100 |
| | 19 | 300 | 0.3 | 550 | >=100 | 80 | 15 | 160 | 5 | 19 |
| | 20 | 450 | 0.4 | 500 | >=100 | 100 | 5 | 180 | 5 | 35 |
| | 21 | 300 | 0.3 | 550 | >=100 | 100 | 5 | 180 | 5 | 35 |
| | 22 | 350 | 0.3 | 500 | >=100 | 100 | 5 | 200 | 1 | 53 |
| | 23 | 350 | 0.3 | 500 | 15 | 100 | 10 | 200 | 2 | 62 |
| | 24 | 350 | 0.3 | 500 | >=100 | 120 | 1 | 180 | 5 | 34 |
| | 25 | 350 | 0.3 | 550 | >=100 | 120 | 5 | 180 | 10 | 41 |
| | 26 | 350 | 0.3 | 550 | >=100 | 140 | 5 | 180 | 1 | 28 |

| | | PERFORMANCE VALUATION | | | | | |
|---|---|---|---|---|---|---|---|
| | No. | TENSILE STRENGTH (MPa) | ELONGATION AFTER FRACTURE (%) | CONDUCTIVITY (% IACS) | IMPACT ABSORBING ENERGY ($J/mm^2$) | NUMBER OF CYCLES TO FRACTURE ($\times 10^4$ CYCLES) | TERMINAL CRIMP PORTION STRENGTH (N) |
| EXAMPLE | 1 | 135 | 13 | 53 | 7 | 32 | 103 |
| | 2 | 240 | 14 | 50 | 24 | 93 | 190 |
| | 3 | 328 | 8 | 46 | 21 | 162 | 221 |
| | 4 | 235 | 18 | 44 | 30 | 82 | 192 |
| | 5 | 270 | 15 | 47 | 31 | 99 | 214 |
| | 6 | 305 | 9 | 44 | 23 | 141 | 204 |
| | 7 | 135 | 19 | 46 | 10 | 42 | 111 |
| | 8 | 345 | 11 | 40 | 33 | 160 | 251 |
| | 9 | 200 | 16 | 47 | 20 | 57 | 166 |
| | 10 | 230 | 19 | 42 | 31 | 73 | 189 |
| | 11 | 325 | 11 | 40 | 30 | 137 | 235 |
| | 12 | 165 | 12 | 51 | 7 | 26 | 140 |
| | 13 | 170 | 15 | 47 | 14 | 47 | 139 |
| | 14 | 310 | 10 | 49 | 24 | 156 | 230 |
| | 15 | 332 | 5 | 48 | 13 | 176 | 189 |

TABLE 3-1-continued

| | | | | | | |
|---|---|---|---|---|---|---|
| 16 | 195 | 12 | 52 | 14 | 60 | 154 |
| 17 | 170 | 11 | 45 | 10 | 73 | 123 |
| 18 | 245 | 8 | 54 | 7 | 66 | 184 |
| 19 | 265 | 13 | 45 | 26 | 96 | 205 |
| 20 | 305 | 14 | 51 | 34 | 132 | 249 |
| 21 | 305 | 14 | 48 | 34 | 132 | 249 |
| 22 | 181 | 14 | 43 | 13 | 54 | 153 |
| 23 | 261 | 12 | 42 | 20 | 97 | 214 |
| 24 | 331 | 12 | 47 | 33 | 150 | 256 |
| 25 | 325 | 11 | 43 | 29 | 164 | 248 |
| 26 | 192 | 18 | 40 | 21 | 60 | 163 |

N.B. NUMERICAL VALUES IN BOLD ITALIC IN THE TABLE ARE OUT OF APPROPRIATE RANGE OF THE EXAMPLE

TABLE 3-2

| | FIRST HEAT TREATEMENT | | SECOND HEAT TREATMENT | | AGING HEAT TREATMENT | | | | |
|---|---|---|---|---|---|---|---|---|---|
| | | | FIRST | | FIRST AGING STEP | | SECOND AGING STEP | | |
| | | | | | SECOND | | THIRD | | |
| No. | HEATING TEMP. (° C.) | AVE. COOLING RATE (° C./s) | PREDETER-MINED TEMP. (° C.) | AVE. COOLING RATE (° C./s) | PREDETER-MINED TEMP. (° C.) | TIME (HOUR) | PREDETER-MINED TEMP. (° C.) | TIME (HOUR) | WIDTH OF PFZ (nm) |
| 27 | 500 | 0.4 | 550 | >=100 | 100 | 1 | 200 | 5 | 72 |
| 28 | 500 | 0.4 | 600 | >=100 | 100 | 5 | 200 | 3 | 56 |
| 29 | 400 | 0.3 | 600 | >=100 | 120 | 10 | 200 | 1 | 53 |
| 30 | 400 | 0.3 | 620 | >=100 | 140 | 5 | 180 | 10 | 44 |
| 31 | 400 | 0.3 | 520 | >=100 | 100 | 1 | 150 | 1 | 9 |
| 32 | 400 | 0.3 | 520 | >=100 | 120 | 5 | 150 | 1 | 8 |
| 33 | 400 | 0.3 | 520 | >=100 | 100 | 10 | 180 | 5 | 41 |
| 34 | 300 | 0.3 | 520 | >=100 | 100 | 1 | 200 | 5 | 73 |
| 35 | 300 | 0.3 | 520 | >=100 | 140 | 1 | 220 | 5 | 96 |
| 36 | 300 | 0.3 | 480 | 65 | 140 | 15 | 160 | 5 | 21 |
| 37 | 300 | 0.3 | 480 | >=100 | 100 | 5 | 160 | 2 | 14 |
| 38 | 300 | 0.3 | 580 | 25 | 120 | 5 | 160 | 15 | 30 |
| 39 | 300 | 0.3 | 580 | >=100 | 100 | 5 | 220 | 5 min | 92 |
| 40 | 300 | 0.3 | 580 | >=100 | 100 | 5 | 250 | 1 min | 98 |
| 41 | 400 | 0.3 | 580 | >=100 | 120 | 5 | 220 | 1 min | 78 |
| 42 | 400 | 0.3 | 580 | >=100 | 80 | 10 | 220 | 10 min | 60 |
| 43 | 400 | 0.3 | 550 | >=100 | 120 | 1 | 200 | 30 min | 41 |
| 44 | 450 | 0.4 | 550 | >=100 | 140 | 5 | 200 | 1 | 56 |
| 45 | 450 | 0.4 | 550 | >=100 | 100 | 1 | 200 | 2 | 68 |
| 46 | 450 | 0.4 | 500 | >=100 | 100 | 5 | 200 | 3 | 58 |
| 47 | 450 | 0.4 | 500 | >=100 | 120 | 1 | 200 | 1 | 53 |
| 48 | 350 | 0.3 | 500 | >=100 | 100 | 5 | 150 | 1 | 8 |
| 49 | 350 | 0.3 | 530 | >=100 | 120 | 15 | 200 | 5 | 60 |
| 50 | 350 | 0.3 | 530 | >=100 | 100 | 5 | 180 | 5 | 34 |
| 51 | 350 | 0.3 | 530 | >=100 | 80 | 5 | 180 | 15 | 49 |
| 52 | 350 | 0.3 | 500 | >=100 | 120 | 1 | 150 | 1 | 9 |

| | PERFORMANCE VALUATION | | | | | |
|---|---|---|---|---|---|---|
| No. | TENSILE STRENGTH (MPa) | ELONGATION AFTER FRACTURE (%) | CONDUCTIVITY (% IACS) | IMPACT ABSORBING ENERGY ($J/mm^2$) | NUMBER OF CYCLES TO FRACTURE ($\times 10^4$ CYCLES) | TERMINAL CRIMP PORTION STRENGTH (N) |
| 27 | 235 | 6 | 55 | 8 | 66 | 150 |
| 28 | 228 | 12 | 44 | 17 | 75 | 184 |
| 29 | 235 | 13 | 41 | 20 | 84 | 194 |
| 30 | 313 | 11 | 45 | 27 | 154 | 240 |
| 31 | 145 | 20 | 50 | 12 | 24 | 119 |
| 32 | 146 | 22 | 51 | 14 | 25 | 119 |
| 33 | 179 | 12 | 55 | 12 | 52 | 141 |
| 34 | 168 | 10 | 56 | 7 | 31 | 131 |
| 35 | 140 | 8 | 57 | 5 | 26 | 104 |
| 36 | 231 | 14 | 50 | 23 | 90 | 183 |
| 37 | 223 | 16 | 47 | 25 | 83 | 180 |
| 38 | 271 | 12 | 50 | 25 | 112 | 208 |
| 39 | 221 | 6 | 50 | 5 | 51 | 146 |
| 40 | 242 | 7 | 45 | 7 | 59 | 172 |
| 41 | 214 | 7 | 47 | 7 | 61 | 147 |
| 42 | 240 | 8 | 46 | 12 | 45 | 168 |
| 43 | 247 | 9 | 47 | 16 | 89 | 174 |

TABLE 3-2-continued

| | | | | | | |
|---|---|---|---|---|---|---|
| 44 | 259 | 8 | 51 | 14 | 78 | 180 |
| 45 | 262 | 8 | 51 | 13 | 84 | 186 |
| 46 | 250 | 7 | 52 | 11 | 83 | 165 |
| 47 | 242 | 9 | 48 | 14 | 86 | 175 |
| 48 | 222 | 14 | 48 | 21 | 76 | 171 |
| 49 | 223 | 9 | 47 | 12 | 74 | 163 |
| 50 | 257 | 10 | 47 | 19 | 112 | 186 |
| 51 | 273 | 7 | 50 | 14 | 115 | 177 |
| 52 | 282 | 10 | 40 | 22 | 128 | 194 |

N.B. NUMERICAL VALUES IN BOLD ITALIC IN THE TABLE ARE OUT OF APPROPRIATE RANGE OF THE EXAMPLE

TABLE 4

| | | FIRST HEAT TREATMENT | | SECOND HEAT TREATMENT | | AGING HEAT TREATMENT | | | | |
|---|---|---|---|---|---|---|---|---|---|---|
| | | | | | | FIRST AGING STEP | | SECOND AGING STEP | | |
| | | | | FIRST | | SECOND | | THIRD | | |
| | No. | HEATING TEMP. (° C.) | AVE. COOLING RATE (° C./s) | PREDETERMINED TEMP. (° C.) | AVE. COOLING RATE (° C./s) | PREDETERMINED TEMP. (° C.) | TIME (H) | PREDETERMINED TEMP. (° C.) | TIME (H) | WIDTH OF PFZ (nm) |
| COMPARATIVE EXAMPLE | 1 | 400 | 0.3 | 550 | >=100 | 100 | 5 | 180 | 5 | ***105*** |
| | 2 | 400 | 0.3 | 550 | >=100 | 100 | 5 | 180 | 5 | ***NONE*** |
| | 3 | 400 | 0.3 | 550 | >=100 | 100 | 5 | 180 | 5 | ***110*** |
| | 4 | 400 | 0.3 | 550 | >=100 | 100 | 5 | 180 | 5 | ***NONE*** |
| | 5 | | | WIRE BREAK DURING DRAWING | | | | | | — |
| | 6 | | | WIRE BREAK DURING DRAWING | | | | | | — |
| | 7 | | | WIRE BREAK DURING DRAWING | | | | | | — |
| | 8 | | | WIRE BREAK DURING DRAWING | | | | | | — |
| | 9 | | | WIRE BREAK DURING DRAWING | | | | | | — |
| | 10 | 400 | 0.3 | 550 | >=100 | 100 | 5 | 180 | 5 | ***NONE*** |
| | 11 | 300 | 0.3 | 530 | >=100 | — | — | 200 | 8 | ***115*** |
| | 12 | 300 | 0.3 | 600 | ***8*** | — | — | 160 | 12 | ***115*** |
| | 13 | 300 | 0.3 | 530 | >=100 | — | — | 200 | 8 | ***110*** |
| | 14 | 300 | 0.3 | 600 | ***8*** | — | — | 180 | 12 | ***110*** |
| | 15 | 300 | 0.3 | ***640*** | >=100 | 120 | 5 | 180 | 5 | ***250*** |
| | 16 | 400 | 0.3 | 530 | ***4*** | 120 | 5 | 180 | 5 | ***NONE*** |
| | 17 | 400 | 0.3 | 550 | >=100 | 120 | 5 | ***260*** | 1 | ***125*** |
| | 18 | 400 | 0.3 | 550 | >=100 | 120 | 5 | ***130*** | 5 | ***NONE*** |

| | | PERFORMANCE VALUATION | | | | | |
|---|---|---|---|---|---|---|---|
| | No. | TENSILE STRENGTH (MPa) | AFTER FRACTURE (%) | CONDUCTIVITY (% IACS) | IMPACT ABSORBING ENERGY ($J/mm^2$) | NUMBER OF CYCLES TO FRACTURE ($\times 10^4$ CYCLES) | TERMINAL CRIMP PORTION STRENGTH (N) |
| COMPARATIVE EXAMPLE | 1 | 190 | 2 | 45 | 1 | 18 | 24 |
| | 2 | 135 | 12 | 60 | 4 | 8 | 48 |
| | 3 | 275 | 2 | 40 | 2 | 16 | 56 |
| | 4 | 140 | 11 | 56 | 4 | 8 | 48 |
| | 5 | — | — | — | — | — | — |
| | 6 | — | — | — | — | — | — |
| | 7 | — | — | — | — | — | — |
| | 8 | — | — | — | — | — | — |
| | 9 | — | — | — | — | — | — |
| | 10 | 81 | 26 | 63 | 1 | 5 | 12 |
| | 11 | 180 | 3 | 48 | 2 | 11 | 28 |
| | 12 | 190 | 4 | 51 | 1 | 9 | 40 |
| | 13 | 230 | 4 | 49 | 4 | 8 | 59 |
| | 14 | 180 | 3 | 47 | 1 | 8 | 28 |
| | 15 | 120 | 1 | 48 | 1 | 5 | 24 |
| | 16 | 128 | 16 | 58 | 7 | 12 | 50 |
| | 17 | 170 | 3 | 57 | 0 | 7 | 23 |
| | 18 | 181 | 14 | 40 | 8 | 15 | 87 |

N.B. NUMERICAL VALUES IN BOLD ITALIC IN THE TABLE ARE OUT OF APPROPRIATE RANGE OF THE EXAMPLE

The following is elucidated from the results indicated in Tables 3-1, 3-2 and 4. Each of the aluminum alloy wires of Examples 1 to 52 had a tensile strength, elongation and conductivity at equivalent levels to those of the related art (aluminum alloy wire disclosed in Japanese Laid-Open Patent Publication No. 2012-229485), and had improved impact resistance and bending fatigue resistance. It also had an improved terminal crimp portion strength. In contrast, the aluminum alloy wires of Comparative Examples 1 to 10 has a chemical composition outside the range of the present disclosure, and each of the aluminum alloy wires of Comparative Examples 1 to 18 has a small number of cycles to fracture of 180,000 times or less, and had a reduced bending fatigue resistance. Those other than Comparative Examples 16 and 18 had a reduced impact resistance as well. Those other than Comparative Example 18 also had a reduced terminal crimp portion strength. Also, each of the Comparative Examples 5 to 9 broke during a wire drawing step. Each of the aluminum alloy wires of Comparative Examples 11 to 15 and 17 that has a chemical composition within the range of the present disclosure but the width of PFZ is out of an appropriate range of the present disclosure each had a reduced impact resistance and bending fatigue resistance.

The aluminum alloy wire of the present disclosure is based on a prerequisite to use an aluminum alloy containing Mg and Si in Al and, and by making a precipitate free zone (PFZ) formed at a grain inside portion located in proximity to the grain boundary appropriate, and particularly when used as an extra fine wire having a strand diameter of less than or equal to 0.5 mm, an aluminum alloy wire rod used as a conductor of an electric wiring structure, an aluminum alloy stranded wire, a coated wire, a wire harness, and a method of manufacturing an aluminum alloy wire rod can be provided with an improved impact resistance and bending fatigue resistance while ensuring strength, elongation and conductivity equivalent to those of a product of the related art (aluminum alloy wire disclosed in Japanese Laid-Open Patent Publication No. 2012-229485), and thus it is useful as a conducting wire for a motor, a battery cable, or a harness equipped on a transportation vehicle, and as a wiring structure of an industrial robot. Particularly, since the aluminum alloy wire rod of the present disclosure has a high tensile strength, a wire size thereof can be made smaller than that of the wire of the related art, and it can be appropriately used for a door, a trunk or a hood requiring a high impact resistance and bending fatigue resistance.

What is claimed is:

1. An aluminum alloy wire rod having a composition consisting of 0.10 mass % to 1.00 mass % Mg; 0.10 mass % to 1.00 mass % Si; 0.01 mass % to 1.40 mass % Fe; 0.000 mass % to 0.100 mass % Ti; 0.000 mass % to 0.030 mass % B; 0.00 mass % to 1.00 mass % Cu; 0.00 mass % to 0.50 mass % Ag; 0.00 mass % to 0.50 mass % Au; 0.00 mass % to 1.00 mass % Mn; 0.00 mass % to 1.00 mass % Cr; 0.00 mass % to 0.50 mass % Zr; 0.00 mass % to 0.50 mass % Hf; 0.00 mass % to 0.50 mass % V; 0.00 mass % to 0.50 mass % Sc; 0.00 mass % to 0.50 mass % Co; 0.00 mass % to 0.50 mass % Ni; and the balance being Al and incidental impurities, wherein at least one of Ti, B, Cu, Ag, Au, Mn, Cr, Zr, Hf, V, Sc, Co and Ni is contained in the composition or none of Ti, B, Cu, Ag, Au, Mn, Cr, Zr, Hf, V, Sc, Co and Ni is contained in the composition, a precipitate free zone exists inside a crystal grain, and the precipitate free zone has a width of less than or equal to 100 nm.

2. The aluminum alloy wire rod according to claim 1, wherein the composition contains one or two element(s) selected from a group consisting of 0.001 mass % to 0.100 mass % Ti; and 0.001 mass % to 0.030 mass % B.

3. The aluminum alloy wire rod according to claim 1, wherein the composition contains one or more element(s) selected from a group consisting of 0.01 mass % to 1.00 mass % Cu; 0.01 mass % to 0.50 mass % Ag; 0.01 mass % to 0.50 mass % Au; 0.01 mass % to 1.00 mass % Mn; 0.01 mass % to 1.00 mass % Cr; 0.01 mass % to 0.50 mass % Zr; 0.01 mass % to 0.50 mass % Hf; 0.01 mass % to 0.50 mass % V; 0.01 mass % to 0.50 mass % Sc; 0.01 mass % to 0.50 mass % Co; and 0.01 mass % to 0.50 mass % Ni.

4. The aluminum alloy wire rod according to claim 1, wherein a sum of contents of Fe, Ti, B, Cu, Ag, Au, Mn, Cr, Zr, Hf, V, Sc, Co, and Ni is 0.01 mass % to 2.00 mass %.

5. The aluminum alloy wire rod according to claim 1, wherein an impact absorption energy is greater than or equal to 5 J/mm$^2$.

6. The aluminum alloy wire rod according to claim 1, wherein number of cycles to fracture measured in a bending fatigue test is greater than or equal to 200,000 cycles.

7. The aluminum alloy wire rod according to claim 1, wherein the aluminum alloy wire rod is an aluminum alloy wire having a diameter of 0.1 mm to 0.5 mm.

8. An aluminum alloy stranded wire comprising a plurality of aluminum alloy wire rods as claimed in claim 7 which are stranded together.

9. A coated wire comprising a coating layer at an outer periphery of the aluminum alloy stranded wire as claimed in claim 8.

10. A coated wire comprising a coating layer at an outer periphery of one of the aluminum alloy wire rod as claimed in claim 7.

11. A method of manufacturing an aluminum alloy wire rod as claimed in claim 1, the aluminum alloy wire rod being obtained by forming a drawing stock through hot or cold working subsequent to melting and casting, and thereafter carrying out processes including a first wire drawing process, a first heat treatment process, a second wire drawing process, a second heat treatment process and an aging heat treatment process in this order, wherein the second heat treatment process is a solution heat treatment which, after heating to a first predetermined temperature within a range of 480° C. to 620° C., cools at an average cooling rate of greater than or equal to 10° C./s, and the annealing heat treatment includes a first annealing step of heating to a second predetermined temperature within a range of higher than or equal to 80° C. and lower than 150° C. and thereafter retaining at the second predetermined temperature, and a second annealing step of heating to a third predetermined temperature within a range of 140° C. to 250° C. and thereafter retaining at the third predetermined temperature, the third predetermine temperature being higher than the second predetermined temperature.

12. A wire harness comprising:

a coated wire including a coating layer at an outer periphery of one of an aluminum alloy wire rod and an aluminum alloy stranded wire, the aluminum alloy stranded wire comprising a plurality of the aluminum alloy wire rods which are stranded together; and a terminal fitted at an end portion of the coated wire, the coating layer being removed from the end portion, wherein the aluminum alloy wire rod has a composition consisting of 0.10 mass % to 1.00 mass % Mg; 0.10 mass % to 1.00 mass % Si; 0.01 mass % to 1.40 mass % Fe; 0.000 mass % to 0.100 mass % Ti; 0.000 mass % to 0.030 mass % B; 0.00 mass % to 1.00 mass % Cu; 0.00 mass % to 0.50 mass % Ag; 0.00 mass % to 0.50 mass % Au; 0.00 mass % to 1.00 mass % Mn; 0.00 mass % to 1.00 mass % Cr; 0.00 mass % to 0.50 mass % Zr; 0.00 mass % to 0.50 mass % Hf; 0.00 mass % to 0.50 mass % V; 0.00 mass % to 0.50 mass % Sc; 0.00 mass % to 0.50 mass % Co; 0.00 mass % to 0.50 mass % Ni; and the balance being Al and incidental impurities, wherein at least one of Ti, B, Cu, Ag, Au, Mn, Cr, Zr, Hf, V, Sc, Co and Ni is contained in the composition or none of Ti, B, Cu, Ag, Au, Mn, Cr, Zr, Hf, V, Sc, Co and Ni is contained in the composition, a precipitate free zone exists inside a crystal grain, and the precipitate free zone has a width of less than or equal to 100 nm.

* * * * *